US009828229B2

(12) United States Patent
Yang

(10) Patent No.: US 9,828,229 B2
(45) Date of Patent: Nov. 28, 2017

(54) REFRIGERATOR AND BEVERAGE SUPPLYING METHOD USING THE SAME

(71) Applicant: Dongbu Daewoo Electronics Corporation, Seoul (KR)

(72) Inventor: Sung Jin Yang, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 42 days.

(21) Appl. No.: 14/981,689

(22) Filed: Dec. 28, 2015

(65) Prior Publication Data

US 2016/0368756 A1 Dec. 22, 2016

(30) Foreign Application Priority Data

Jun. 18, 2015 (KR) ..... 10-2015-0086324

(51) Int. Cl.

| | |
|---|---|
| ***B67D 3/00*** | (2006.01) |
| ***B67D 3/02*** | (2006.01) |
| ***F25D 23/12*** | (2006.01) |
| *F25D 23/04* | (2006.01) |

(52) U.S. Cl.

CPC ..... *B67D 3/0035* (2013.01); *B67D 3/0009* (2013.01); *B67D 3/02* (2013.01); *F25D 23/126* (2013.01); *B67D 3/0087* (2013.01); *F25D 23/04* (2013.01); *F25D 2331/803* (2013.01); *F25D 2331/806* (2013.01)

(58) Field of Classification Search

CPC ..... B67D 3/0009; B67D 3/02; B67D 3/0087; F25D 2331/806

USPC ..... 141/351, 360, 363–366; 62/389; 222/322

See application file for complete search history.

(56) References Cited

U.S. PATENT DOCUMENTS

| | | | | |
|---|---|---|---|---|
| RE22,837 E * | 1/1947 | Sanchis | B67D 3/02 | 141/296 |
| 5,791,517 A * | 8/1998 | Avital | B67D 3/00 | 222/1 |
| 6,131,774 A * | 10/2000 | Thomas | G01F 11/34 | 222/181.2 |
| 6,945,433 B2 * | 9/2005 | Laible | B67D 7/0294 | 222/185.1 |
| 2010/0293986 A1 * | 11/2010 | Jung | F25D 23/126 | 62/389 |

FOREIGN PATENT DOCUMENTS

| | | |
|---|---|---|
| KR | 20-1996-0015025 U | 5/1996 |
| KR | 20-0109849 Y1 | 11/1997 |

(Continued)

*Primary Examiner* — Timothy L Maust

(57) ABSTRACT

A refrigerator having a storage unit disposed on the inside of a door and capable of dispensing beverage from a beverage container stored in the storage unit. A supporting unit is disposed on the storage unit for supporting the beverage container downward. The supporting unit has a first mounting hole. A valve is coupled to a mouth of the beverage container for selectively allowing beverage contained in the beverage container to be dispensed. At least a portion of the valve is located in the first mounting hole. A lever is disposed under the supporting unit and coupled to the valve. When an upward external force is applied to the lever, the valve is open and allows the beverage to be supplied to the outside of the beverage container through the mouth of the beverage container.

10 Claims, 7 Drawing Sheets

(56) References Cited

FOREIGN PATENT DOCUMENTS

| | | | |
|---|---|---|---|
| KR | 10-1998-0023829 | A | 7/1998 |
| KR | 10-0181656 | B1 | 5/1999 |
| KR | 10-2009-0080250 | A | 7/2009 |

* cited by examiner

REFRIGERATOR AND BEVERAGE SUPPLYING METHOD USING THE SAME

CROSS-REFERENCE TO RELATED APPLICATIONS

This application claims priority to Korean Patent Application No. 10-2015-0086324, filed Jun. 18, 2015, hereby incorporated by reference in its entirety.

FIELD OF THE INVENTION

The present invention relates to refrigerators and beverage dispensers in refrigerators.

BACKGROUND OF THE INVENTION

Refrigerators are electrical appliances capable of maintaining a storage chamber below room temperature. Food can be stored in a refrigerator in a cold or frozen state.

The interior of the refrigerator is cooled by cold air circulation. Cold air is produced through heat exchange with a refrigerant in a refrigeration cycle that includes a compression-condensation-expansion-evaporation process. The cold air supplied into the refrigerator is distributed to the interior of the refrigerator by convection to obtain a desired storage temperature.

A refrigerator typically has a rectangular main body with doors located in the front. The main body may include a refrigerating chamber and a freezing chamber, each having its own door. The refrigerator may include a plurality of drawers, shelves, storage boxes for sorting and storing food or other objects, etc.

FIG. 1 is a perspective view showing a conventional refrigerator 1. As shown in FIG. 1, the refrigerator 1 includes a main body including a food storage space and a door 2 coupled to the main body. A tray 4 is provided on the inside of the door 2, which is suitable for storing beverage containers 5. The tray 4 defines a storage space 3 and has a support member 4.

However, it is not easy for children, the old, or the weak to directly take large and heavy beverage containers (e.g., as shown by 5) out of the refrigerator as the beverage container may drop.

In addition, if an opened carbonated beverage is contained in a beverage container 5, carbonic acid may evaporate in a few days after opening the beverage container 5, which causes the carbonated beverage to taste bad.

Furthermore, during the course that a beverage container 5 is taken out and then placed back, the door 2 may be open a long a time, which causes loss in cooling performance of the refrigerator 1.

SUMMARY OF THE INVENTION

Therefore, the present invention has been made in view of the above problems, and it is an object of the present invention to provide a refrigerator that is capable of enabling a user to obtain beverage from a beverage container stored at the inside of a door of the refrigerator without taking out the beverage container.

According to an aspect of a refrigerator, the refrigerator comprises: a main body having a food storage space defined therein; a door for selectively shielding the food storage space; a storage unit formed at an inside of the door for storing a beverage container; a supporting unit disposed at the storage unit for supporting the beverage container upward, the supporting unit having a first mounting hole; a valve coupled to a mouth of the beverage container for selectively allowing beverage contained in the beverage container to be supplied to an outside of the beverage container, at least a portion of the valve being located in the first mounting hole; and a lever provided under the supporting unit in a state of being coupled to the valve for cooperating with the valve such that upward external force is applied to the lever, wherein when the upward external force is applied to the lever, the valve allows the beverage to be supplied to the outside of the beverage container through the mouth of the beverage container.

Further, the supporting unit is provided with a fixing recess, where an end of the mouth of the beverage container is inserted into the fixing recess.

Further, the valve has an insertion recess on its upper end thereof with, into which the mouth is inserted. The mouth has a thread on its outer circumferential surface. The insertion recess has a spiral portion coupled to the thread on its inner circumferential surface.

Further, an upper end of the valve is located higher than a lower end of the supporting unit, and a lower end of the valve is located lower than the lower end of the supporting unit.

Further, an outer diameter of the upper end of the valve is greater than a diameter of the first mounting hole. An outer diameter of the lower end of the valve is less than the diameter of the first mounting hole. The valve is supported upward by the supporting unit in a state of being inserted into the first mounting hole from above.

Further, the valve comprises: a stationary unit directly coupled to the mouth, the stationary unit having a flow channel, the stationary unit being placed in the first mounting hole; a moving unit configured to move upward and downward for selectively opening and closing the flow channel; and an elastic body for providing downward elastic force to the moving unit when the moving unit moves upward, and the lever is coupled to the moving unit.

Further, wherein, when the upward external force is applied to the lever, the lever and the moving unit move upward together, the flow channel is opened, and the beverage is supplied to the outside of the beverage container through the flow channel.

Further, the lever is a plate member having a second mounting hole, and an outer circumferential surface of the moving unit is coupled to an inner circumferential surface of the second mounting hole, or the moving unit extends through the second mounting hole from top to bottom, an outer diameter of an upper end of the moving unit being greater than a diameter of the second mounting hole, an outer diameter of a lower end of the moving unit being less than the diameter of the second mounting hole.

According to an embodiment, a beverage supplying method comprises: coupling a valve to a mouth of a beverage container, from which a cap has been removed; storing the beverage container, to which the valve is coupled, in a storage unit formed at an inside of a door of a refrigerator; applying an upward external force to a lever cooperating with the valve; operating the valve using the applied upward external force; and supplying beverage in the beverage container to an outside of the beverage container according to the operation of the valve.

Further, the beverage container is stored in the storage unit in a state in which the mouth is directed downward.

BRIEF DESCRIPTION OF THE DRAWINGS

Embodiments of the present invention will be better understood from a reading of the following detailed description, taken in conjunction with the accompanying drawing figures in which like reference characters designate like elements and in which.

DETAILED DESCRIPTION OF THE INVENTION

Figure 1:
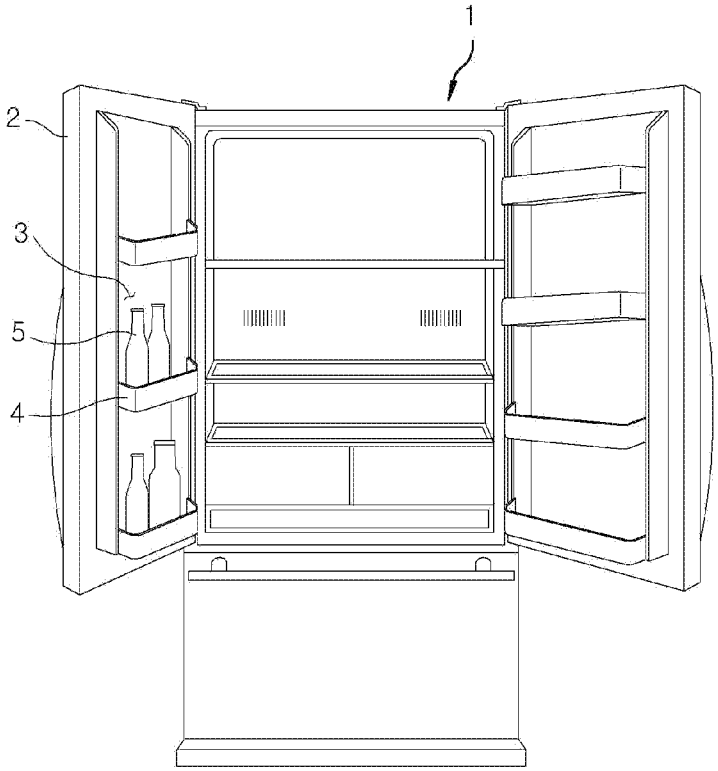
FIG. 1 is a perspective view showing a conventional refrigerator.

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail so as not to unnecessarily obscure aspects of the embodiments of the present invention. The drawings showing embodiments of the invention are semi-diagrammatic and not to scale and, particularly, some of the dimensions are for the clarity of presentation and are shown exaggerated in the drawing Figures. Similarly, although the views in the drawings for the ease of description generally show similar orientations, this depiction in the Figures is arbitrary for the most part. Generally, the invention can be operated in any orientation.

Refrigerator and Beverage Supplying Method Using the Same

Figure 2:
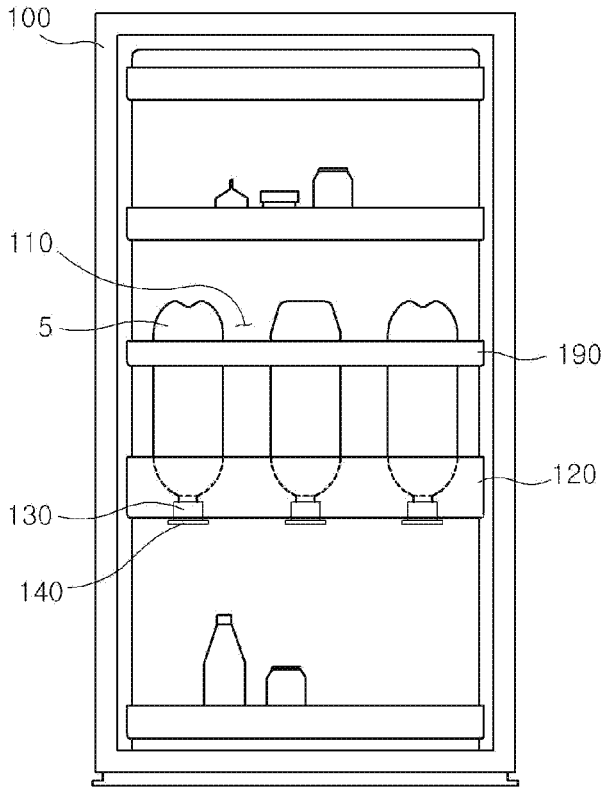
FIG. 2 is a view showing the inside of a door of an exemplary refrigerator according to an embodiment of the present invention.
Figure 3:
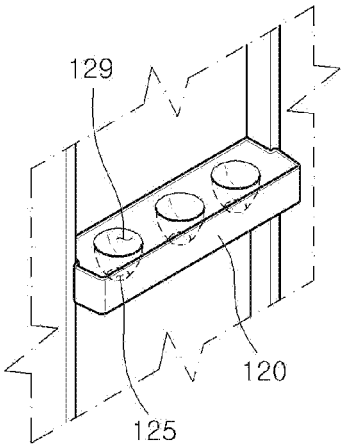
FIG. 3 is an enlarged perspective view of an exemplary supporting unit shown in FIG. 2 according to an embodiment of the present invention.

FIG. 2 shows the inside of a door of an exemplary refrigerator according to an embodiment of the present invention. FIG. 3 is an enlarged perspective view of a supporting unit shown in FIG. 2.

As shown in FIG. 2, a storage unit 110 for beverage containers is disposed on the inside of a door 100. The storage unit 110 may be in a recess on the inside of the front door 100, or on a supporting unit 120 protruding from the inside of the door 100.

The supporting unit 120 on the storage unit 110 may support the beverage container 5 upward. As shown, the beverage container 5 may be stored upside down. That is, the top of the beverage container 5 faces downward, and the bottom of the beverage container 5 faces upward.

More specifically, as shown in FIG. 3, a fixing recess 129 is formed in the supporting unit 120. The fixing recess 129 may have various shapes, e.g., a bowl shape. The top of the beverage container 5 may be inserted into the fixing recess 129. As shown, the beverage container 5 is positioned without the risk of falling to the left or the right.

The storage unit 110 may have a retaining bar extending from the inside of the door 100 in left and right directions of the door 100. The retaining bar can further prevent the beverage container 5 from falling.

A valve 130 is disposed in a first mounting hole 125 shown in FIG. 3. For example, the valve 130 may be inserted into the first mounting hole 125 from above. The upper end of the valve 130 may be located higher than the first mounting hole 125, and the lower end of the valve 130 may be located lower than the first mounting hole 125. In other words, the upper end of the valve 130 may be located higher than the lower end of the supporting unit 120, and the lower end of the valve 130 may be located lower than the lower end of the supporting unit 120.

In addition, the valve 130 may be coupled to the mouth of the beverage container 5. The valve controls dispensing of beverage to the outside.

A lever 140 may be disposed under the supporting unit 120. An upward external force may be applied to the lever 140. For example, when a user pushes a cup upward in a state in which the cup is in contact with a lower surface of the lever 140, the upward external force can be passed to the lever 140.

The lever 140 may be coupled to the valve. When the upward external force is applied to the lever 140 as described above, the valve 130 may open and allow the beverage in the beverage container 5 to be dispensed from the beverage container 5.

Figure 4:
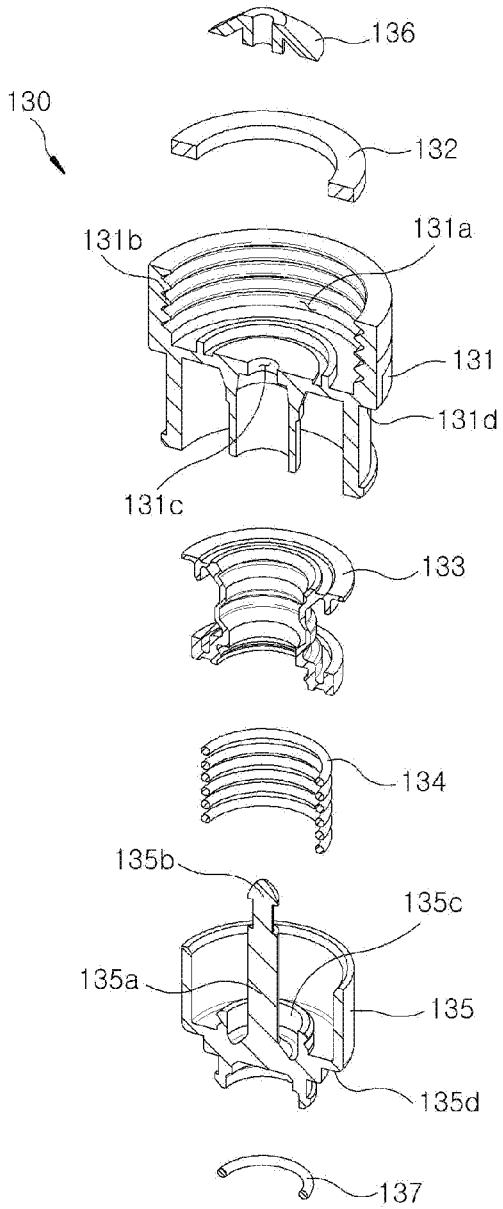
FIG. 4 is an exploded perspective view of an exemplary valve shown in FIG. 2 according to an embodiment of the present invention.

FIG. 4 is an exploded perspective view of the valve shown in FIG. 2. As shown in FIG. 4, the valve 130 may include a first body 131, a second body 133, a third body 135, a gate 136, an elastic body 134, and at least one packing member 132 and 137.

The upper end of the first body 131 may be a portion that is directly coupled to the mouth of the beverage container 5. An insertion recess 131*a* may be formed at the upper end of the first body 131, and at least a portion of the mouth of the beverage container 5 may be inserted into the insertion recess 131*a*. Each beverage container 5 has a thread for coupling with a cap. The insertion recess 131*a* may be disposed on the inner circumferential surface with a spiral portion 131*b*, which is coupled to the thread. The mouth of the beverage container 5 may be coupled to the insertion recess 131*a* after or while being inserted into the insertion recess 131*a*.

The insertion recess 131*a* may have a flow channel 131*c* near the center of its lower part. The beverage introduced to the insertion recess 131*a* from the beverage container 5 may flow downward under the first body 131 through the flow channel 131*c*. A packing member for preventing leakage of the beverage may be disposed at the lower part of the insertion recess 131*a*.

A step portion 131*d* may be formed at the first body 131. As shown, the outer diameter of the upper end of the first body 131 may be greater than that of the lower end of the first body 131. The step portion 131*d* may be formed due to the difference in outer diameter between the upper and lower ends of the first body 131. In addition, the outer diameter of the upper end of the first body 131 may be greater than the diameter of the first mounting hole 125, and the outer diameter of the lower end of the first body 131 may be less than the diameter of the first mounting hole 125. As a result, the first body 131 may be inserted into the first mounting hole 125 from above, but may be located in the first mounting hole 125, since the step portion 131*d* is supported upward by the supporting unit 120.

The second body 133 may be located under the first body 131. The second body 133 may be formed in the shape of a pipe that extends vertically. The second body 133 may be coupled between the flow channel 131*c* extending from the first body 131 and a flow channel 135*c* formed in the third body 135, which will be further described below. The elastic body 134, such as a coil spring, may be disposed on the outer circumferential surface of the second body 133. When the valve is operated, the elastic body 134 may be pushed upward by the third body 135. When an external force applied to the third body 135 is removed, the elastic body 134 may provide downward elastic force (restoring force) to the third body 135 such that the third body 135 returns to the initial position thereof.

The third body 135 is mostly located under the second body 133. However, a portion of the third body 135 may extend upward through the second body 133 such that the portion of the third body 135 is located above the second body 133. Specifically, an upwardly extending stem 135*a* may be disposed proximate to the center of the third body 135. An upper end 135*b* of the stem 135*a* may be coupled to the gate 136. More specifically, the stem 135*a* may extend upward through the center of the second body 133, which has a pipe shape. Consequently, the upper end 135*b* of the stem 135*a* may be located in the insertion recess 131*a* of the first body 131. The gate 136 may be coupled to the upper end 135*b* of the stem 135*a* in the insertion recess 131*a*. The gate 136 may move upward or downward to selectively open and close the flow channel 131*c*.

The beverage passing through the first body 131 and the second body 133 from the beverage container 4 may finally be dispensed to the outside through the flow channel 135*c* of the third body 135. The packing member 137 for preventing leakage of the beverage may be provided at the lower part of the third body 135.

In addition, a step portion 135*d* may also be formed at the third body 135. As shown, the outer diameter of the upper end of the third body 135 may be greater than that of the lower end of the third body 135. The step portion 135*d* may be formed by a difference in outer diameter between the upper and lower ends of the third body 135. In addition, the outer diameter of the upper end of the third body 135 may be greater than that of a second mounting hole 145 formed at the lever 140, and the outer diameter of the lower end of the third body 135 may be less than that of the second mounting hole 145. As a result, the third body 135 may be inserted into the second mounting hole 145 from above. As will hereinafter be described, when external force is applied to the lever 140 and thus the lever 140 moves upward, the lever 140 may transmit the external force to the step portion 135*d* such that the third body 135 also moves upward.

The first body 131 and the packing member 132 may correspond to a stationary unit. The stationary unit may be a portion that is directly coupled to the mouth of the beverage container 5, is provided with the flow channel 131*c*, and is placed in the first mounting hole 125 of the supporting unit 120. The stationary unit may remain stationary while in use.

The third body 135 and the gate may correspond to a moving unit. The moving unit may be a portion that moves upward and downward for selectively opening and closing the flow channel 131*c*. For example, the gate 136 may close the flow channel 131*c* in the insertion recess 1431*a*, and then open the flow channel 131*c* according to an upward movement of the moving unit, including the gate 136. When the flow channel 131*c* is opened, the beverage in the beverage container 5 may flow downward through the flow channel 131*c*. In addition, when the moving unit moves upward, the elastic body 134 may be compressed upward to provide a downward elastic force (restoring force) to the moving unit.

For reference, the second body 133 may correspond to the stationary unit or the moving part based on the design of the valve 130.

Figure 5:
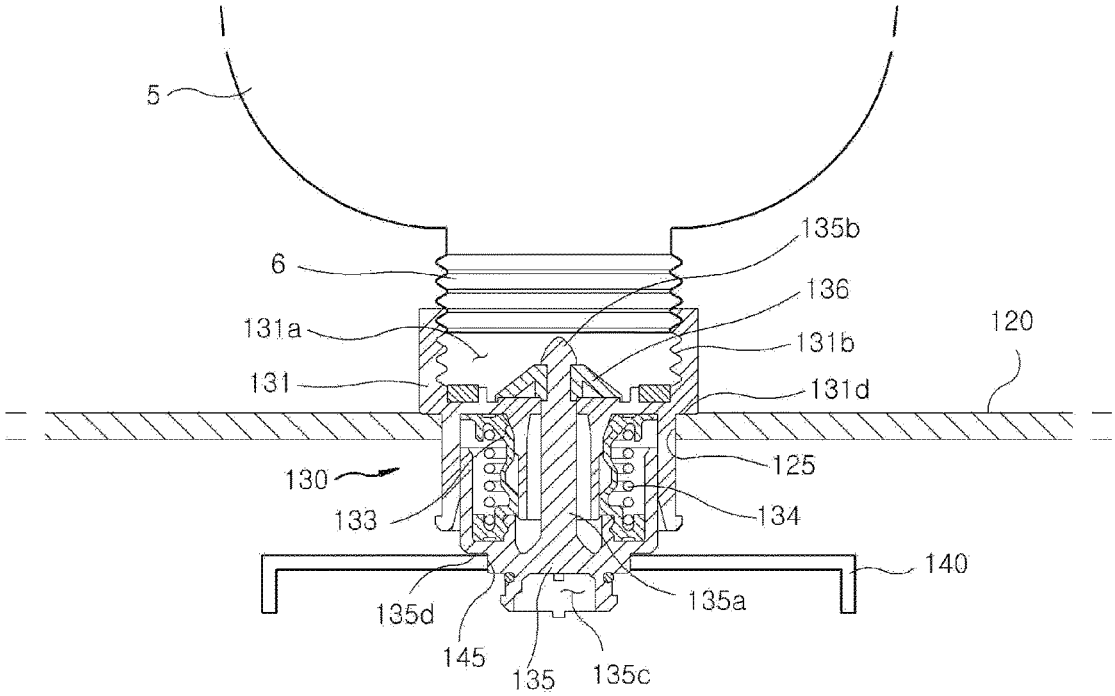
FIG. 5 is a view showing a state in which a beverage container is stored according to an embodiment of the present invention.

FIG. 5 shows a state in which the beverage container 5 is stored in accordance with an embodiment of the present disclosure. In the state shown in FIG. 5, the beverage in the beverage container 5 may not be dispensed to the outside.

The mouth 6 of the beverage container 5, from which the cap has been removed, may be inserted and coupled into the valve 130, more specifically the insertion recess 131*a* formed at the upper end of the first body 1. As previously described, the thread formed at the outer circumferential surface of the mouth 6 may engage with the spiral portion 131*b* formed at the inner circumferential surface of the insertion recess 131*a*. As a result, the beverage container 5 may be fixed to the valve, whereby the beverage container 5 may be prevented from falling.

The step portion 131*d* is formed on the first body 131. The first body 131 may be supported upward by the supporting unit 120 when inserted into the first insertion hole 125 from the above.

The gate 136 in the insertion recess 131*a* closes the flow channel 131*c* of the first body 131 while covering a bottom surface of the insertion recess 131*a*. Consequently, the beverage in the beverage container 5 is not discharged under the first body 131 even when the beverage is introduced into the insertion recess 131*a* through the mouth 6.

The lever 140 may be a plate member having the second mounting hole 145. As shown, the step portion 135*d* may be disposed at the lower end of the third body 135 of the valve 130, and the third body 135 may extend through the second mounting hole 145 from top to bottom. When upward external force is applied to the lever 140 and the lever 140 moves upward, the external force may be passed to the third body 135 through the step portion 135*d*. As a result, the third body 135 may also move upward. In a modification, the outer circumferential surface of the third body 135 and the inner circumferential surface of the second mounting hole 145 may be coupled to each other by bonding, welding, etc.

Figure 6:
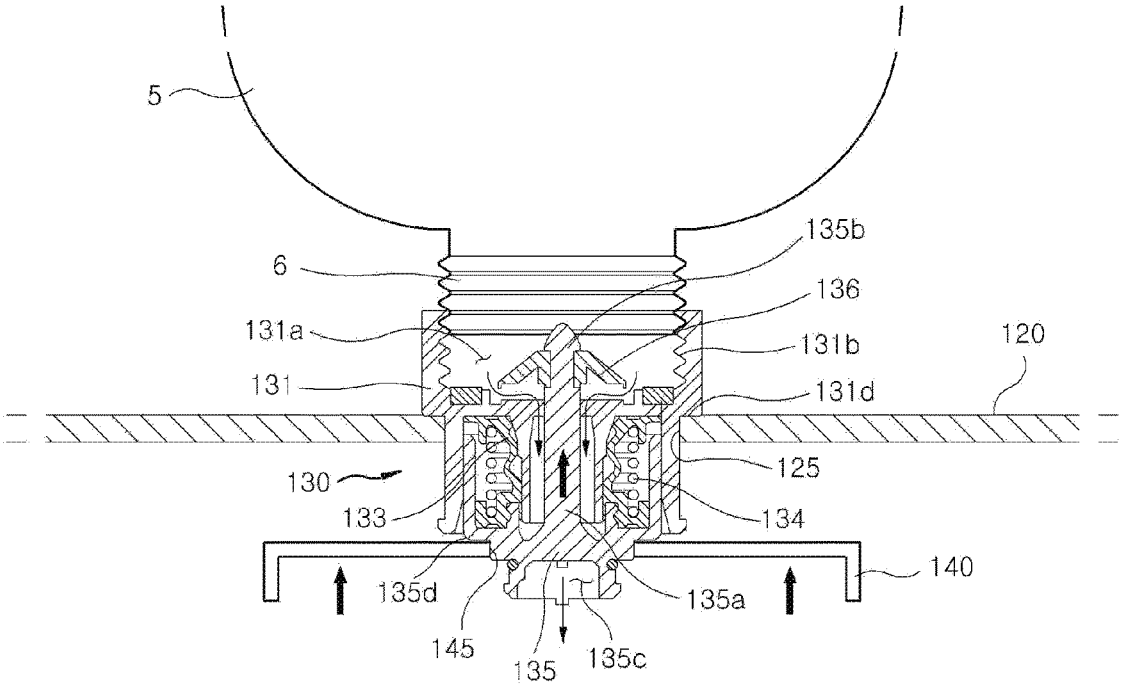
FIG. 6 is a view showing a state in which beverage in the beverage container is dispensed to the outside according to an embodiment of the present invention.

FIG. 6 shows a state in which the beverage in the beverage container is dispensed to the outside in accordance with an embodiment of the present disclosure.

First, an upward external force may be applied to the lever 140. For example, the user may push a cup upward in a state in which the upper end of the cup is in contact with the lower surface of the lever 140. When the upward external force is applied to the lever 140 by the user's operation, the lever 140 may move upward. When moving upward, the lever 140 may push the third body 135 upward through the step portion 135*d*. As a result, the third body 135 may also move upward. Due to the upward movement of the third body 135, the stem 135*a* and the gate 136 coupled to the upper end 135*b* of the stem 135*a* may also move upward. According to the upward movement of the gate 136, a space is generated between the gate 136 and the bottom surface of the insertion recess 131*a*. As a result, the beverage in the beverage container 5 may be introduced into the flow channel 131*c* through the space. The beverage introduced into the flow channel 131*c* may be supplied to the outside through the second body 133 and the flow channel 135*c* of the third body 135. Therefore, when the user applies an external force to the lever 140 using the cup, the beverage may be directly dispensed into the cup through the valve 130.

Figure 7:
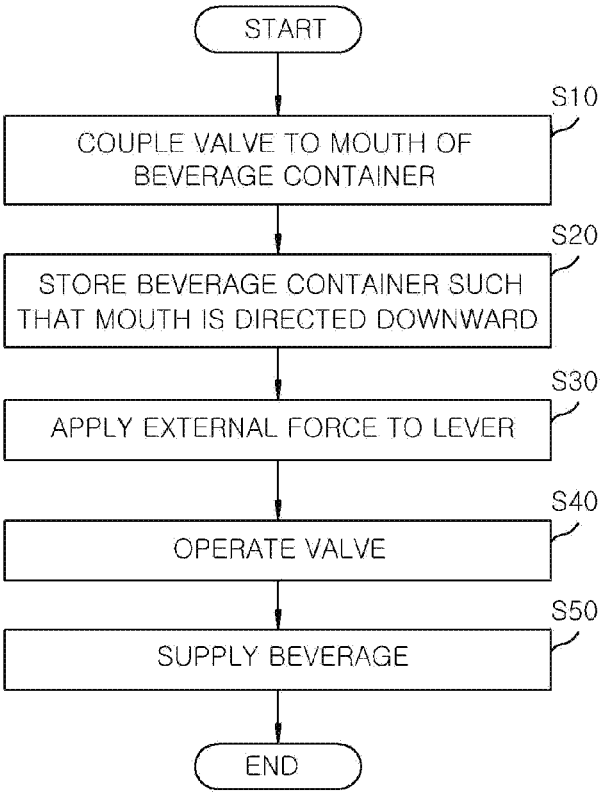
FIG. 7 is a flowchart showing a beverage supplying method according to an embodiment of the present invention.

FIG. 7 is a flowchart showing an exemplary beverage dispensing method according to an embodiment of the present invention.

First, the cap of the beverage container 5 may be removed, and then the valve 130 may be coupled to the mouth 6 of the beverage container 5 (S10). At this time, the beverage container 5 may be in a state in which the beverage container 5 is not upside down, e.g., a state in which the mouth 6 is directed upward, and the valve 130 may be coupled to the mouth 6 in a state in which the valve 130 is upside down, which is the opposite of the state described with reference to FIGS. 2 to 6. That is, the mouth 6 may be coupled to the spiral portion 131*b* formed at the inner circumferential surface of the insertion recess 131*a* in a state in which the insertion recess 131*a* of the first body 131 is directed downward.

The beverage container 5 coupled to the valve 130 may be placed in the storage unit 110 in a state in which the beverage container 5 is upside down (S20). In other words, the end of the mouth 6 of the beverage container 5 and the valve 130 may be located at the bottom. The valve 130 may be inserted into the first mounting hole 125 of the supporting unit 120 from above. At this time, the step portion 131*d* of the first body 131 may be caught by the supporting unit 120. As a result, the valve 130 may be placed in the first mounting hole 125 and may be supported upward by the supporting unit 120.

In another embodiment, the supporting unit 120 may be detachably mounted to the door 100, and the valve 130 may be coupled into the first mounting hole 125 of the supporting unit 120. The supporting unit 120, which has been separated from the door 100, may be located above the beverage container 5, which is not upside down after removal of the cap, in a state of being upside down (e.g., the fixing recess 129 is directed downward). In this state, the end of the mouth 6 of the beverage container 5 may be inserted into the fixing recess 129. Subsequently, the beverage container 5 may be rotated to couple the mouth 6 and the valve 130. After the coupling between the mouth 6 and the valve 130 is achieved, the supporting unit 120 may be turned upside down again (e.g., the fixing recess 129 is directed upward) and then mounted to the door 100.

When the user opens the door 100 and pushes a cup upward so that the cup is in contact with the lower surface of the lever 140 in order to get beverage from the beverage container 5, an upward external force may be applied to the lever 140 (S30). When the upward external force is applied to the lever 140, the valve is operated (S40), and the beverage in the beverage container 5 may flow downward and then be dispensed into the cup (S50), as previously described with reference with FIG. 6.

In the refrigerator and the beverage supplying method according to the embodiments as described above, it is possible to get beverage from a bulky and heavy beverage container 5 without directly taking the beverage container 5 out of the refrigerator. Consequently, it is possible to protect children, the old, or the weak from injuries which may be caused while taking the beverage container 5 out of the refrigerator.

In addition, as the beverage container 5 needs not be taken out of the refrigerator by the user for consuming the beverage, and the time for the door 100 being open is reduced as compared with a conventional refrigerator. Advantageously, the overall cooling efficiency of the refrigerator is improved and power consumption is reduced.

Furthermore, because the beverage container 5 is stored upside down, if a carbonated beverage is contained in the beverage container 5, the evaporation of carbonic acid can be reduced.

Embodiments of the present disclosure enable a user to get beverage from a beverage container stored on the inside of a door of the refrigerator without taking out the beverage container.

Although certain preferred embodiments and methods have been disclosed herein, it will be apparent from the foregoing disclosure to those skilled in the art that variations and modifications of such embodiments and methods may be made without departing from the spirit and scope of the invention. It is intended that the invention shall be limited only to the extent required by the appended claims and the rules and principles of applicable law.

What is claimed is:

1. A refrigerator comprising:

a door; and a storage unit located on the door for storing a beverage container, wherein the storage unit comprises:

a supporting unit for supporting the beverage container, the supporting unit comprising a first mounting hole;

a valve operable to be coupled to a mouth of the beverage container for selectively enabling a beverage contained in the beverage container to be dispensed therefrom, wherein at least a portion of the valve is located in the first mounting hole; and a lever disposed under the supporting unit and coupled to the valve, wherein, responsive to an upward external force applied to the lever, the valve dispenses the beverage through the mouth of the beverage container, wherein the valve comprises:

a stationary unit connected to the mouth, the stationary unit comprising a flow channel, the stationary unit disposed in the first mounting hole;

a moving unit configured to move upward and downward for selectively opening and closing the flow channel; and an elastic body for exerting downward elastic force to the moving unit when the moving unit moves upward, wherein the lever is coupled to the moving unit, wherein the lever is plate-shaped and having a second mounting hole, and wherein an outer circumferential surface of the moving unit is coupled to an inner circumferential surface of the second mounting hole, or the moving unit extends through the second mounting hole from top to bottom, wherein an outer diameter of an upper end of the moving unit is greater than a diameter of the second mounting hole, and wherein an outer diameter of a lower end of the moving unit is less than the diameter of the second mounting hole.

2. The refrigerator according to claim 1, wherein the supporting unit is provided with a fixing recess, and an end of the mouth of the beverage container is inserted into the fixing recess.

3. The refrigerator according to claim 1, wherein:

the valve comprises an insertion recess at an upper end thereof, wherein the mouth is inserted into the insertion recess;

the mouth comprises a thread at an outer circumferential surface thereof; and the insertion recess is disposed at an inner circumferential surface thereof with a spiral portion coupled to the thread.

4. The refrigerator according to claim 1, wherein an upper end of the valve is located higher than a lower end of the supporting unit, and a lower end of the valve is located lower than the lower end of the supporting unit.

5. The refrigerator according to claim 4, wherein:

an outer diameter of the upper end of the valve is greater than a diameter of the first mounting hole;

an outer diameter of the lower end of the valve is less than the diameter of the first mounting hole; and the valve is supported upward by the supporting unit in a state of being inserted into the first mounting hole from above.

6. The refrigerator according to claim 1, wherein, when the upward external force is applied to the lever, the lever and the moving unit move upward together, the flow channel opens, and the beverage is dispensed from the beverage container through the flow channel.

7. A refrigerator comprising:

a door; and a beverage dispenser disposed on an inside of the door, the beverage dispenser comprising:

a supporting unit for supporting a beverage container, the supporting unit comprising a first mounting hole;

a valve installed in the supporting unit, wherein the value is operable to be coupled to a mouth of the beverage container for selectively dispensing beverage therefrom, wherein valve comprises an insertion recess on an upper end of the valve, wherein at least a portion of the valve is disposed in the first mounting hole, and wherein further the insertion recess comprises a spiral portion coupled to a thread on an inner circumferential surface of the insertion recess; and a lever disposed under the supporting unit and coupled to the valve, wherein, when the lever is subject to an upward external force, the valve enables the beverage to be dispensed from the beverage container through a mouth of the beverage container, wherein the valve comprises:

a stationary unit directly coupled to the mouth of the beverage container, the stationary unit comprising a flow channel and disposed in the first mounting hole;

a moving unit configured to move upward and downward for selectively opening and closing the flow channel; and an elastic body configured to apply a downward elastic force to the moving unit when the moving unit moves upward, wherein the lever is coupled to the moving unit, wherein, when the upward external force is applied to the lever, the lever and the moving unit move upward together, the flow channel opens, and the beverage is dispensed from the beverage container through the flow channel, and wherein the lever is plate-shaped and comprising a second mounting hole, wherein an outer circumferential surface of the moving unit is coupled to an inner circumferential surface of the second mounting hole, wherein an outer diameter of an upper end of the moving unit is greater than a diameter of the second mounting hole, and wherein an outer diameter of a lower end of the moving unit is less than the diameter of the second mounting hole.

8. The refrigerator according to claim 7, wherein: the upper end of the valve is located higher than a lower end of the supporting unit; and a lower end of the valve is located lower than the lower end of the supporting unit.

9. The refrigerator according to claim 7, wherein:

an outer diameter of the upper end of the valve is greater than a diameter of the first mounting hole;

an outer diameter of the lower end of the valve is less than the diameter of the first mounting hole; and the valve is supported upward by the supporting unit when the valve is inserted into the first mounting hole from above.

10. The refrigerator according to claim 7, wherein the moving unit extends through the second mounting hole from top to bottom.

* * * * *